United States Patent [19]

Kumazawa et al.

[11] Patent Number: 4,626,197

[45] Date of Patent: Dec. 2, 1986

[54] SPACE HEATER

[75] Inventors: Katsuyoshi Kumazawa, Yamato; Toshio Ohtsuki, Yokohama; Minoru Komori, Ebina, all of Japan

[73] Assignee: Kabushiki Kaisha Toshiba, Kawasaki, Japan

[21] Appl. No.: 716,457

[22] Filed: Mar. 27, 1985

[30] Foreign Application Priority Data

Mar. 31, 1984 [JP] Japan ..... 59-63688

[51] Int. Cl.[4] ..... F23D 3/02

[52] U.S. Cl. ..... 431/302; 431/201; 431/309; 126/96

[58] Field of Search ..... 126/95–97; 431/200, 201, 243, 302, 309, 320, 344

[56] References Cited

U.S. PATENT DOCUMENTS 241,773 5/1881 Lighthall ..... 431/320
4,465,457 8/1984 Ishikawa et al. ..... 126/96

FOREIGN PATENT DOCUMENTS 52-32136 3/1977 Japan .
57-47111 3/1982 Japan .
57-43106 3/1982 Japan .

*Primary Examiner*—Samuel Scott
*Assistant Examiner*—Noah Kamen
*Attorney, Agent, or Firm*—Cushman, Darby & Cushman

[57] ABSTRACT

A wick temperature control unit is provided for controlling the temperature of a wick having the lower end portion dipped in a fuel tank for storing liquid fuel and the upper end portion inserted in a combustion chamber through a narrow path. The wick soaks up the liquid fuel by capillary action in the combustion chamber and evaporates the liquid fuel therein. The wick temperature control unit holds the temperature of the upper end portion of the wick in accordance with a given heating power state, thereby contributing to widen a heating power adjustment range.

29 Claims, 12 Drawing Figures

SPACE HEATER

BACKGROUND OF THE INVENTION

The present invention relates to a wick type space heater mainly used for indoor heating and, more particularly, to a space heater having a wide heating power adjustment range.

Wick type space heaters have prevailed as indoor heating equipment. Conventional wick type space heaters are classified into wick slide type, fuel head type and fuel compression type heaters with respect to fuel supply systems. These types of heaters are further classified into single or plural cylinder type heaters.

The main part of a conventional wick type space heater, e.g., a typical plural cylinder type heater in a kerosene stove has the following construction. The main part comprises a fuel tank, inner and outer flame cylinders concentrically arranged above the fuel tank so as to constitute a combustion chamber therebetween, a narrow path for causing the combustion chamber to communicate with the fuel tank, and a wick, the lower end portion of which is dipped in kerosene in the fuel tank and the upper end portion of which is inserted in the combustion chamber through the narrow path to soak up kerosene by capillary action. A plurality of vent holes are formed in the inner and outer cylinders to supply air to the combustion chamber. The kerosene vapor evaporated from the upper end of the wick is combusted in the combustion chamber. In addition, by adjusting an exposed portion of the wick in the combustion chamber, the heating power is adjusted.

In such a kerosene stove, the upper end portion of the wick exposed in the combustion chamber is fired by an ignition unit, and air required for combustion is supplied from the plurality of vent holes formed in the inner and outer flame cylinders, thereby accelerating combustion. Heat generated by this combustion heats the exposed upper end portion of the wick in the combustion chamber to increase the evaporation amount of the kerosene. For this reason, the combustion area is gradually increased. In order to improve the combustion efficiency in a wick type kerosene stove, a combustion region is provided at the upper portion of the combustion chamber, and a premixing region for air and the fuel vapor must be provided at the lower portion of the combustion chamber. For this reason, the vent holes formed in the upper portions of the inner and outer flame cylinders generally have a larger diameter than those in the lower portions thereof, thereby limiting the amount of air supplied to the lower portion of the combustion chamber. As described above, when the combustion area is enlarged, it is gradually shifted from the lower portion to the upper portion of the combustion chamber. When the combustion region is shifted to the upper portion of the combustion chamber, heat received by the upper end portion of the wick reaches its upper limit, as does the evaporation amount of kerosene. As a result, when the heat radiated from the upper end portion of the wick is balanced with the heat supplied to the upper end portion thereof, a steady combustion state is achieved In such a wick type kerosene stove, the following problem is presented. When the wick is moved downward to decrease the heating power, i.e., when the exposed portion of the wick exposed in the combustion chamber is decreased, the evaporation amount of kerosene is temporarily decreased to lower the heating power. However, the combustion region is shifted to a lower portion of the combustion chamber to increase the temperature of the upper end portion of the wick again, thereby increasing the evaporation amount of kerosene. Even if the wick is vertically moved to adjust the heating power, the actual adjustable range is very narrow. In addition to this disadvantage, smooth heating power adjustment cannot be performed. When the wick is rapidly moved upward to increase the heating power, i.e., when the exposed portion of the wick is rapidly increased, the upper end portion of the wick which is saturated with fuel is exposed in a high-temperature atmosphere. As a result, kerosene evaporation is rapidly accelerated, and complete combustion cannot be performed in the combustion chamber. Excessive flame rise leads to an unsafe condition. When weak combustion is set, the exposed portion of the wick must be sufficiently decreased. Under this condition, the combustion region is shifted to the lowermost position of the combustion chamber. As a result, the premixing region for air and fuel vapor is decreased to increase exhaustion of toxic gases such as CO and THC.

SUMMARY OF THE INVENTION

It is an object of the present invention to provide a wick type space heater, wherein a heating power adjustment range can be widened without a complicated construction, and excessive flame in the high flame mode and toxic gases in the low flame mode can be prevented.

In order to achieve the above object of the present invention, there is provided a space heater comprising: a fuel tank for storing liquid fuel; a combustion chamber arranged above the fuel tank; a narrow path for causing the combustion chamber to communicate with the fuel tank; a wick, a lower end portion of which is dipped in the liquid fuel in the fuel tank and an upper end portion of which is inserted in the narrow path to soak up the liquid fuel by capillary action, the liquid fuel soaked up by the wick being evaporated; a wick position control mechanism for moving the upper end portion of the wick upward into the combustion chamber when combustion is performed and moving the upper end portion downward in the narrow path when extinguishing is performed; and means for controlling the temperature of the wick.

According to the present invention, since the means is provided for positively controlling the wick temperature, the heating power adjustment range can be widened. The amount of fuel vapor from the exposed upper end wick portion in the combustion chamber is determined by the temperature and the exposed length of the upper end portion of the wick. The heating power is determined by the amount of fuel which evaporates. The temperature of the upper end portion of the wick is easily changed by heat received from the combustion region. When the temperature of the upper end portion of the wick is excessively increased upon application of heat from the combustion region, the heating power cannot be decreased even if the exposed upper end portion of the wick is decreased. In order to increase the heating power adjustment range, some means is provided for controlling the temperature of the upper end portion of the wick. If the temperature of the upper end portion of the wick can be kept constant, the heating power should be proportional to the exposed length of the upper end portion of the wick. When the exposed length of the upper end portion of the wick is kept at a predetermined value, the heating power should be proportional to the temperature of the upper end portion of the wick. The present invention is based upon the above two assumptions. When the means for positively controlling the temperature of the wick is arranged according to the invention, the temperature of the upper end portion of the wick can be controlled to widen the heating power adjustment range as compared with the conventional adjustment range. In addition, smooth heating power control can also be performed. The actual heat capacity of the wick is the sum of the heat capacities of the wick and the temperature control means. The heat capacity of the temperature control means has large heat inertia. For this reason, if the wick is rapidly moved upward to increase the heating power, a dangerously high flame will not be generated. Furthermore, since means is provided for controlling the temperature of the wick, a weak combustion state can be obtained even if the wick is moved downward near the lowermost portion of the combustion chamber. Therefore, even if a weak combustion state is set, the premixing region can be sufficiently guaranteed, thereby preventing generation of toxic gases.

DETAILED DESCRIPTION OF THE PREFERRED EMBODIMENTS

Figure 1:
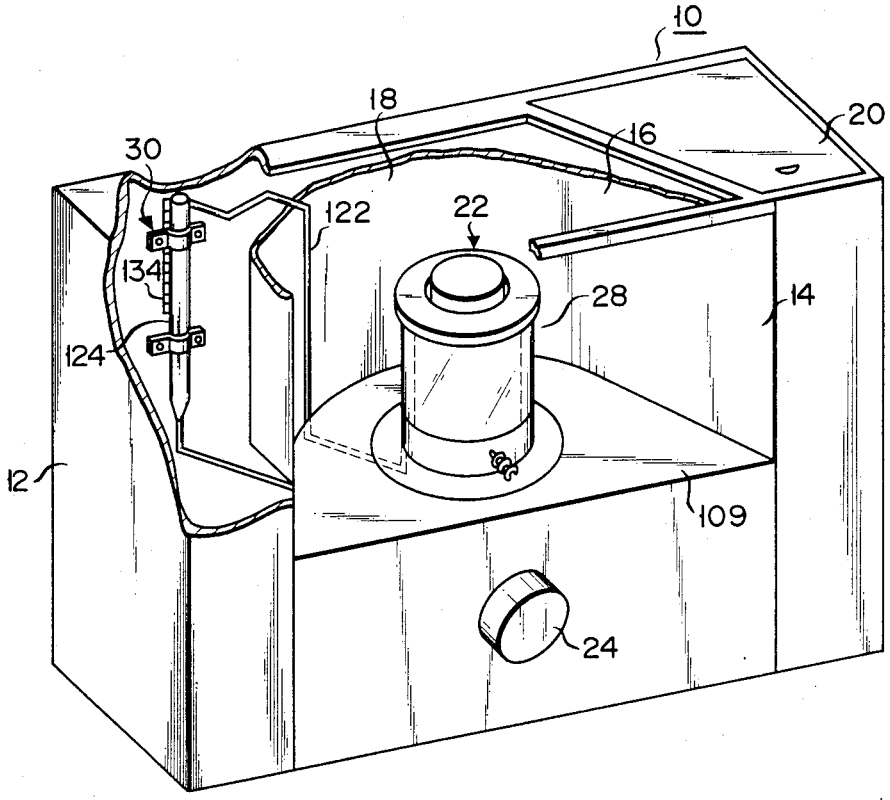
FIG. 1 is a partially cutaway perspective view of a wick type kerosene stove which adopts the present invention.

FIG. 1 shows a wick type kerosene stove 10 which adopts the present invention. Openings 14 and 16 are formed at the front and upper surface portions of a housing 12 of the stove 10. A heat reflector 18 is arranged in the housing 12 to oppose the opening 14. A cartridge type kerosene tank 20 is detachably mounted outside the heat reflector 18 in the housing 12. A burner 22 is disposed in front of the reflector 18. A knob 24 is mounted on the front wall portion of the housing 12 and is located immediately under the opening 14.

Figure 2:
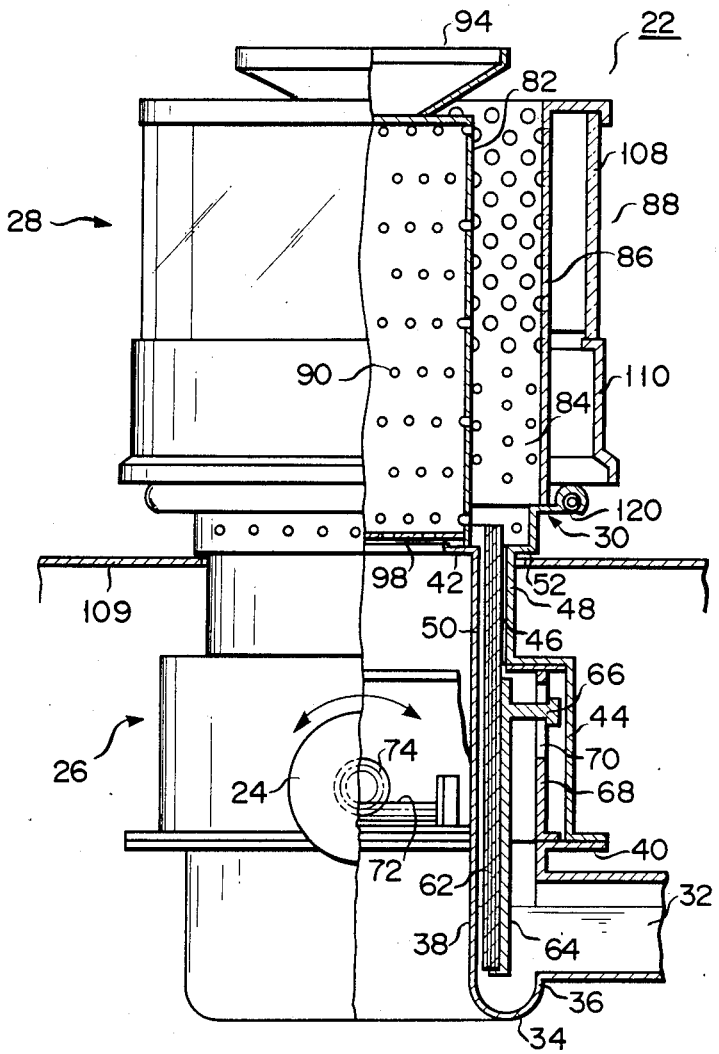
FIG. 2 is a partially cutaway side view of a burner incorporated in the kerosene stove of FIG. 1.
Figure 3:
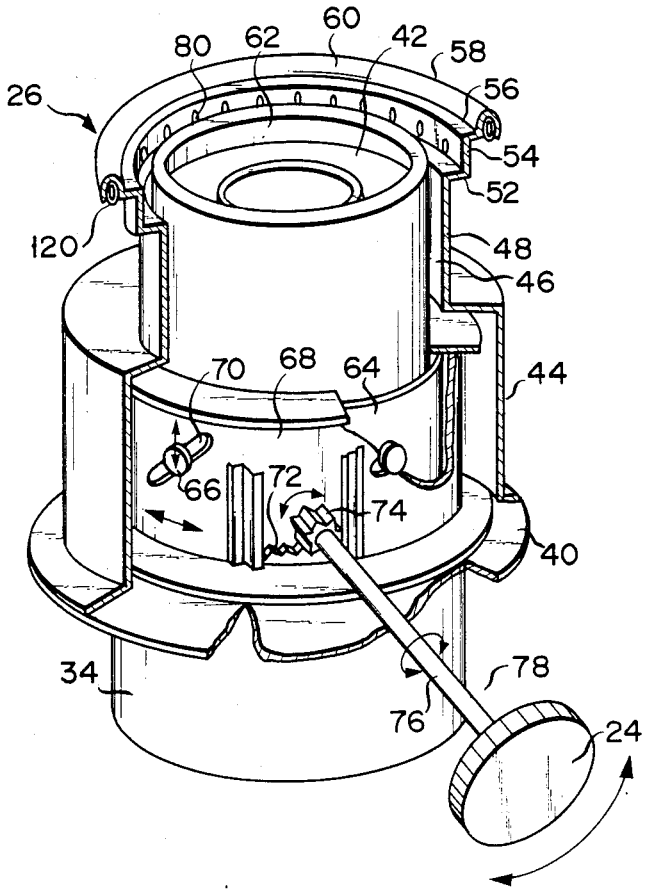
FIG. 3 is a partially cutaway perspective view of a fuel supply portion of the burner shown in FIG. 2.
Figure 4:
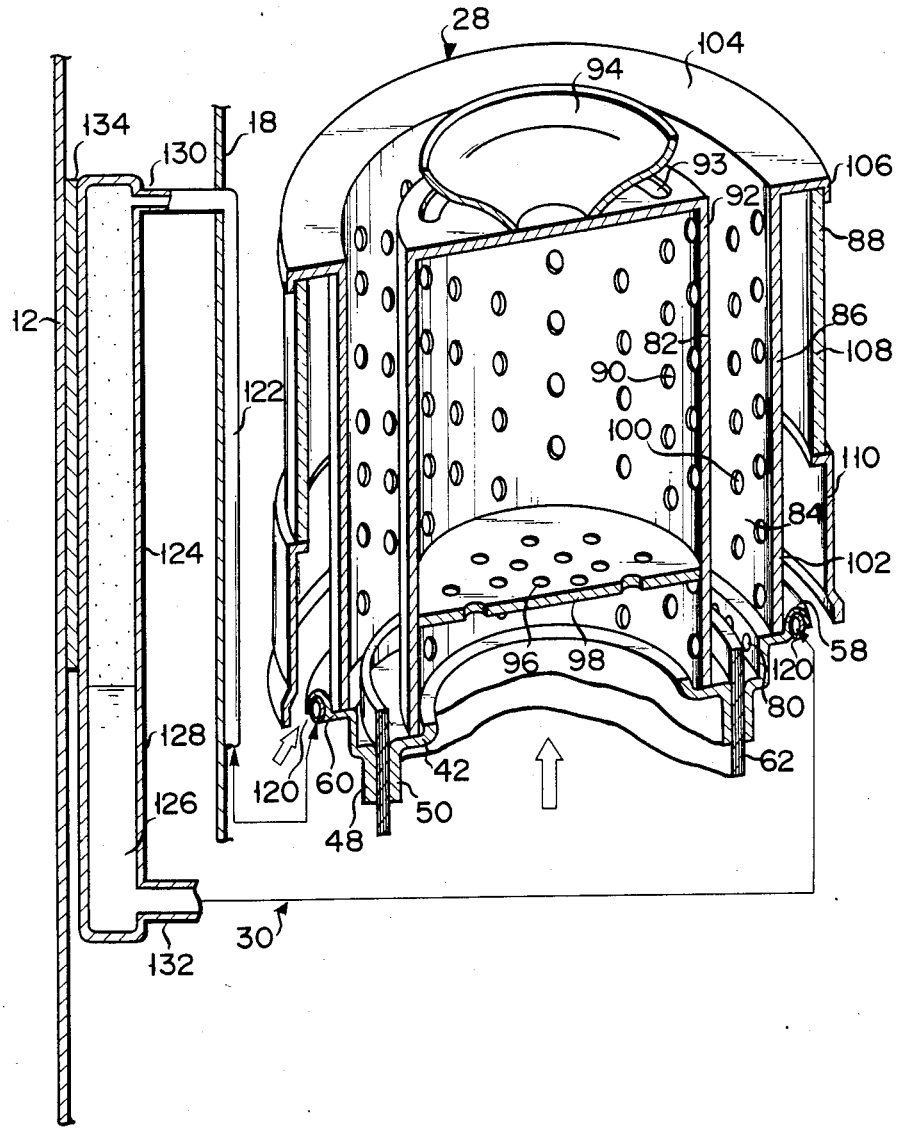
FIG. 4 is a longitudinal sectional view of a combustion portion of the burner and a wick temperature control unit.

The burner 22 is constructed as shown in FIGS. 2 to 4. As shown in FIG. 2, the burner 22 comprises a fuel supply portion 26, a combustion portion 28 and a wick temperature control unit 30.

The fuel supply portion 26 is disposed such that the opening faces upward, and comprises an annular fuel tank 34 to be replenished by the tank 20 with kerosene 32 up to a predetermined level, as shown in FIGS. 2 and 3. The tank 34 is made of a metal. An inner wall 38 of the fuel tank 34 is significantly longer than its outer wall 36 along the axial direction. A collar 40 is formed at the upper end of the outer wall 36 and is bent outward. A collared grate 42 is formed at the upper end of the inner wall 38. A stepped metal cylinder 44 is coaxial with the outer wall 36 and is liquid-tightly fixed on the upper surface of the collar 40. The lower portion of the cylinder 44 has a larger diameter than that of the outer wall 36 of the fuel tank 34, and the upper portion of the cylinder 44 has a smaller diameter than that of the outer wall 36. The upper portion of the cylinder 44 and the upper portion of the inner wall 38 constitute wick guide cylinders 48 and 50 for guiding a wick 62 to be described later. First to fourth portions 52 to 58 are integrally formed with the upper end portion of the cylinder 48, as shown in FIG. 3. The first portion 52 has the same level as that of the grate 42 and extends slightly outward. The second portion 54 is integrally formed with the distal end of the portion 52 and extends upward for a predetermined length. The third portion 56 is integrally formed with the distal end of the portion 54 and extends horizontally for a predetermined length. The fourth portion 58 is integrally formed with the portion 56 and extends upward. The portions 56 and 58 constitute a grate 60 for supporting an outer flame cylinder 86 to be described later. The wick 62 of glass fiber or the like is inserted in a narrow annular path 46 defined by the cylinders 48 and 50 to soak up kerosene by capillary action. The lower end portion of the wick 62 is dipped in kerosene in the tank 34. The wick 62 has a thickness sufficient to cause the inner and outer surfaces of the wick to be brought into sliding contact with the corresponding surfaces of the cylinders 48 and 50. The wick 62 is supported by a support cylinder 64 disposed in a portion surrounded by the tank 34 and the cylinder 44. The cylinder 64 is vertically movable but not rotatable. Pins 66 extend outward from the outer surface of the support cylinder 64 and are fitted in inclined holes 70 formed in a cylinder 68 rotatably supported by the collar 40. A rack 72 is fixed on the outer surface of the cylinder 68, as shown in FIG. 3. The rack 72 meshes with a pinion 74. The pinion 74 is coupled to a shaft 76 liquid-tightly extending through the cylinder 44. The shaft 76 is coupled to the knob 24. The knob 24, the shaft 76, the pinion 74, the rack 72, the cylinder 68, the holes 70, the pins 66 and the cylinder 64 constitute a wick position control mechanism 78. The upper end of the portion 54 formed at the upper end of the cylinder 48 has substantially the same level as the uppermost end of the wick 62 when the wick 62 is set in a minimum combustion state. A plurality of vent holes 80 are formed in the portion 54.

The combustion portion 28 is constructed in the following manner. As shown in FIG. 4, the combustion portion 28 comprises an inner flame cylinder 82 placed on the grate 42 formed at the upper end of the cylinder 50, an outer flame cylinder 86 defining a combustion chamber 84 together with the inner flame cylinder 82 placed on the portion 56 constituting the grate 60, and an outer cylinder 88 surrounding the outer flame cylinder 86.

The cylinder 82 comprises: a cylinder 92 disposed such that the opening thereof faces downward and having the top surface and vent holes 90 formed in the circumferential surface; holes 93 formed in the upper surface of the cylinder 92; a funnel-shaped air flow deflector 94 for deflecting the air flow through the inner space of the cylinder 92 and the holes 93 so as to perform final combustion; and a disk-like air flow limiting plate 98 fixed inside the cylinder 92 and having a plurality of vent holes 96. The cylinder 86 comprises: a cylinder 102 having open ends and a plurality of vent holes 100 on its circumferential surface; a collar 104 integrally formed with the upper end portion of the cylinder 102 and extending outward; and a projected circumferential wall 106 extending slightly downward from the edge of the collar 104. The holes 90 and 100 formed in the upper portions of the cylinders 82 and 86 have larger diameters than those in the lower portions thereof, respectively. With this arrangement, the amount of air supplied to the upper space in the chamber 84 is larger than that supplied to the lower space thereof. The cylinder 88 comprises a transparent glass cylinder 108 and a cylinder 110 which are coaxially and vertically coupled. The upper end of the cylinder 108 is fixed on the wall 106. The cylinders 82 and 86 are coupled by a connecting rod (not shown). The portions 26 and 28 constructed as described above are mounted on a partition plate 109 through a hole in such a manner that a portion located above the upper end of the portion 26 is externally exposed.

The wick temperature control unit 30 is arranged in the following manner. As shown in FIG. 4, the unit 30 comprises: a heat-absorbing pipe 120 of a good conductor such as copper or aluminum which substantially surrounds the outer surface of the portion 58 constituting the grate 60 and which is caulked at the fourth portion 58; an air bubble pump thin pipe 122, one end of which is connected to one end of the pipe 120 and the other end of which extends upward above the level of the pipe 120 along the inner surface of the heat reflector 18; a heat radiator 124 inserted between the other end of the pipe 122 and the other end of the pipe 120; and a working fluid 126 such as alcohol sealed in a closed loop consisting of the radiator 124 and the pipes 120 and 122. The radiator 124 is made of a good heat conductor such as copper or aluminum and comprises a vertical vessel 128 whose lower end is located at a level higher than the level of the pipe 120, and connecting portions 130 and 132 connected to the upper and lower ends of the vessel 128. The upper half of the outer surface of the vessel 128 is fixed through a good heat conductor 134 on the wall surface of the housing 12 located at the rear surface of the reflector 18.

The operation of the kerosene stove having the construction described above will be described hereinafter.

The knob 24 is rotated to move the upper end portion of the wick 62 upward above the grate 42. When the knob 24 is further rotated, the pinion 74 is rotated to move the rack 72 in a circumferential direction. As a result, the cylinder 68 is rotated. The cylinder 64 will not be rotated since it is coupled through the pins 66 inserted in the holes 70 formed in the cylinder 68, but the cylinder 64 is vertically movable. When the cylinder 68 is rotated, a vertical force acts on the cylinder 64 through the pins 66. In this manner, when the knob 24 is rotated, the upper end portion of the wick 62 is exposed inside the combustion chamber 84. In this case, part of the kerosene 32 stored in the tank 34 is soaked up through the wick 62 by capillary action and reaches the upper end portion of the wick 62.

In this state, the upper end portion of the wick 62 is lit by an ignition unit (not shown). At the beginning of ignition, the wick 62 is kept at a low temperature. For this reason, the flame formed at the upper end portion of the wick 62 is low and the heating power is minimal. When a predetermined period of time has elapsed, the temperature of the upper end portion of the wick 62 is increased since it receives heat from the combustion region. For this reason, the evaporation amount of kerosene from the upper end portion of the wick 62 is increased, and the heating power is also increased. When the heating power is increased, the temperature of the grate 60 located on the upper end of the cylinder 48 is increased by heat radiated from the combustion region. When the temperature of the grate 60 is thus increased, the temperature of the pipe 120 integrally coupled to the outer surface of the grate 60 is also increased. Therefore, part of the fluid 126 present in the pipe 120 evaporates. Upon evaporation, the vapor is converted to bubbles which then move to the pipe 122. The bubbles are moved into the radiator 124 while moving the working fluid in the pipe 122 upward. Since the inner surface of the vessel 128 of the radiator 124 is kept at the same low temperature as that of the housing 12, the vapor flowing in the radiator 124 is cooled and condensed by the inner surface of the vessel 128. The condensed liquid flows into the pipe 120 again. The path for evaporating the liquid in the pipe 120, condensing the vapor in the radiator 124 and supplying the condensed liquid to the pipe 120 again is the same as that of a conventional heat pipe. In this embodiment, the unit 30 has the same heat exchange principle as in a heat pipe and positively cools the grate 60. The grate 60 is integrally formed with the upper end of the cylinder 48, and the cylinder 48 is in contact with the wick 62. When heat transfer is performed as described above, the wick 62 is effectively cooled. The unit 30 cools the upper end portion of the wick 62. Unlike the case wherein the unit 30 is not used, the upper end portion of the wick 62 is effectively kept at a low temperature. In this embodiment, the above tendency is typically observed in the weak combustion state wherein the exposed portion of the wick 62 is decreased. The heating power in the weak combustion state properly corresponds to the portion of the wick 62 which is exposed in the combustion chamber 84.

Figure 5A:
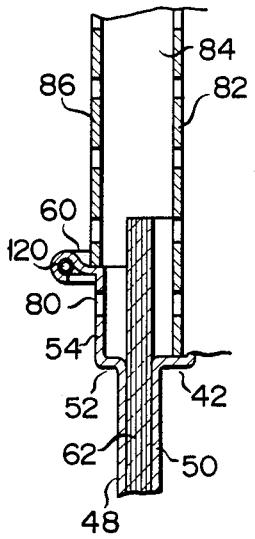
FIGS. 5A to 5C are sectional views for explaining the wick positions in the combustion and noncombustion modes.
Figure 5B:
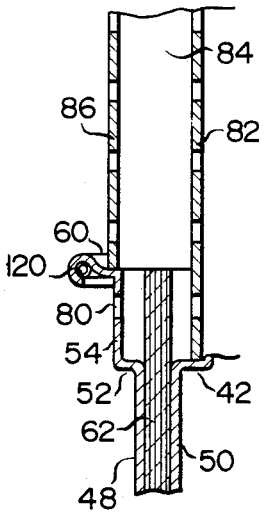
Figure 5C:
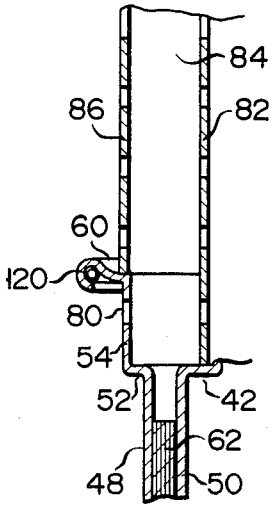

The above relationship in this embodiment will be described in more detail. In order to set a strong combustion state, the exposed length of the wick 62 is increased, as shown in FIG. 5A. The combustion region is shifted to the upper portion of the combustion chamber 84, and the distance between the combustion region and the grate 60 is thus increased. For this reason, the heat received by the grate 60 is decreased, and the heat transfer amount of the unit 30 is decreased. The temperature of the uppermost portion of the wick 62 will not greatly receive the influence of the unit 30. The temperature of the uppermost portion of the wick 62 is determined by heat received from the combustion region and is kept at a high temperature. The amount of fuel evaporation becomes significant, and thus a strong combustion state is obtained. However, when the wick 62 is moved downward to decrease the exposed area of the wick 62 so as to decrease the heating power, the combustion region is shifted to the lower portion of the chamber 84. Under this condition, the distance between the combustion region and the grate 60 is shortened. Heat received by the grate 60 is increased, and the heat transfer amount of the unit 30 is also increased, thereby preventing a temperature rise in the upper end portion of the wick 62. By changing the exposed portion of the wick 62, continuous heating power adjustment can be performed within the weak combustion range. As shown in FIG. 5B, when the wick 62 is lowered to obtain the minimum combustion state, the uppermost portion of the wick 62 comes sufficiently close to the portion 54 formed on the upper end of the cylinder 48. For this reason, the uppermost portion of the wick 62 receives the thermal influence of the portion 54 and is kept at a low temperature. Heat generated from the upper end portion of the wick 62 is minimized, and a very weak combustion state is maintained. In this case, in order to obtain identical heat assuming that the portion 54 is not present, the wick 62 must be moved further downward from the position shown in FIG. 5B. However, when the wick 62 is moved downward in this manner, air shortage occurs resulting in an unstable flame and it is very difficult to maintain a stable continuous combustion state. In this embodiment, since the cooling effect by the portion 54 is sufficient, the weak combustion state can be maintained since air is sufficiently supplied. FIG. 5C shows the position of the wick 62 in the noncombustion state.

In this manner, the unit 30 is provided for controlling the temperature of the upper end portion of the wick 62 in accordance with a desired preset heating power state. Without inviting structural complexity, the lower limit of stable combustion can be greatly decreased, and the heating power adjustment range can be widened. The wick 62 is thermally coupled to the unit 30. The heat capacity of the wick 62 is very large since it is the sum of the heat capacities of the wick 62 itself and the unit 30. Even if the exposed portion of the wick 62 is rapidly increased so as to increase the heating power, the kerosene drawn up to the upper end portion of the wick 62 will not abruptly evaporate. Therefore, an excessively high flame will not be generated. In addition, since stable weak combustion can be performed even if the exposed portion of the wick 62 is greatly decreased, toxic gases will not be produced even in the weak combustion state.

Figure 6:
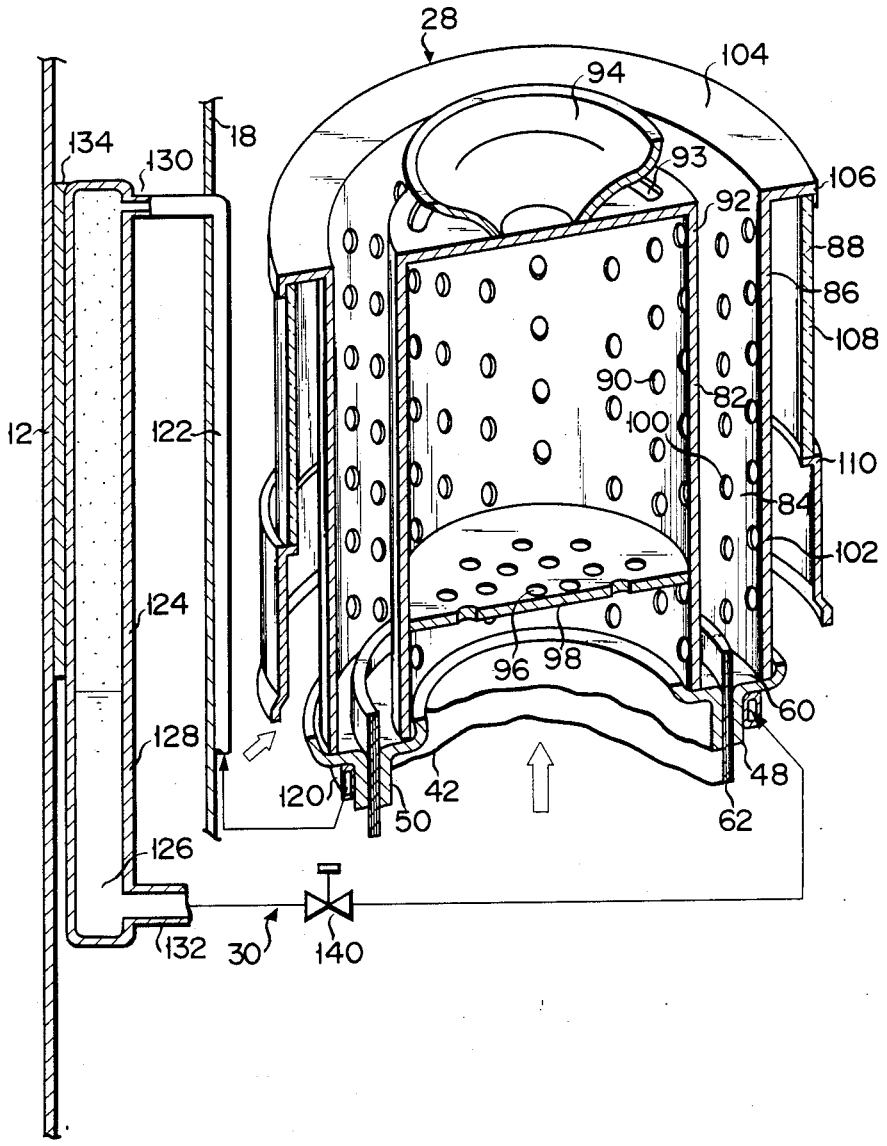
FIG. 6 is a sectional view showing a burner and a wick temperature control unit of another wick type kerosene stove which adopts the present invention.

FIG. 6 shows the main part of a wick type kerosene stove according to another embodiment of the present invention. The same reference numerals in FIG. 6 denote the same parts as in FIG. 4, and a detailed description thereof will be omitted.

In the kerosene stove in FIG. 6, a valve 140 is inserted between a connecting portion 132 of a heat radiator 124 and a heat-absorbing pipe 120. An operation knob of the valve 140 is externally operated. The operation knob is operated to change the flow rate of a working fluid 126 circulated in the unit 30. In the kerosene stove in this embodiment, the exposed portion of a wick 62 in a combustion chamber 84 can be kept constant (except in a noncombustion state) even if the operation state varies from a weak combustion state to a strong combustion state. By adjusting the opening of the valve 140, the heat transfer amount of the unit 30 is changed, and the temperature of the upper end portion of the wick 62 is controlled. In other words, the heating power is controlled by adjusting the opening of the valve 140. In the kerosene stove in this embodiment, the first portion 52 and the second portion 54 which are formed in the wick guide cylinder 48 of the kerosene stove shown in FIGS. 1 to 5 are omitted. In addition, the pipe 120 is fixed by brazing to the outer surface of the cylinder 48.

In the kerosene stove having the construction described above, when the upper end portion of the wick 62 is lit while it is exposed at a predetermined length in the chamber 84, combustion is started. When the upper end portion of the cylinder 48 is heated by heat radiated from the combustion region, the pipe 120 located near the cylinder 48 is also heated. The fluid 126 in the pipe 120 is evaporated, and the heat transfer operation is started. Under this condition, when the opening of the valve 140 is narrowed to decrease the flow rate of the fluid 126 circulating in the unit 30, the heat transfer amount is decreased, and thus the temperature of the upper end portion of the wick 62 is increased. The amount of kerosene evaporation from the upper end portion of the wick 62 is increased to obtain a strong combustion state. When the opening of the valve 140 is increased, to increase the flow rate of the fluid 126 circulating in the unit 30, the heat transfer amount is increased to cool the upper end portion of the wick 62. Therefore, the amount of kerosene evaporation from the upper end portion of the wick 62 is decreased to obtain the weak combustion state.

As is apparent from the operation described above, continuous heating power control can be performed from the weak combustion state to the strong combustion state by merely adjusting the opening of the valve 140. In the same manner as in the first embodiment, the heating power adjustment range can be widened, without an excessive flame occurring or toxic gases being produced.

Figure 7:
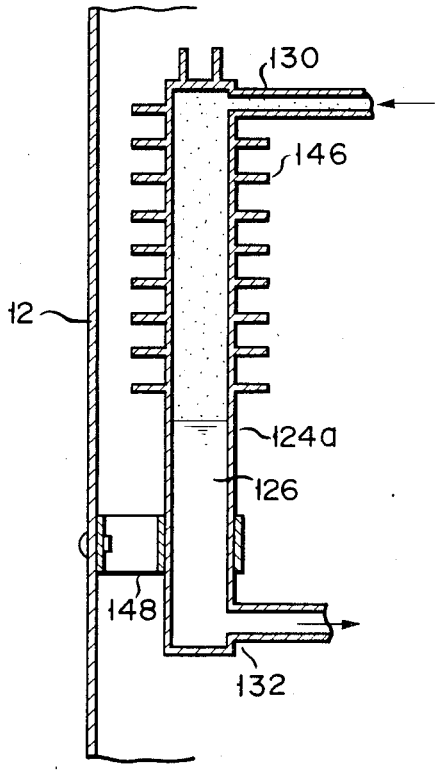
FIG. 7 is a sectional view showing a modification of a heat radiator.
Figure 8:
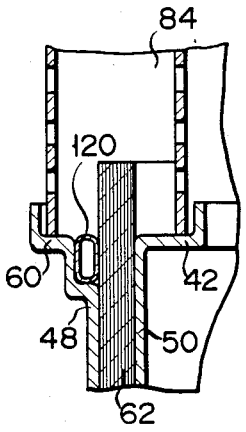
FIGS. 8 and 9 are sectional views showing modifications for explaining installation methods of heat-absorbing pipe.
Figure 9:
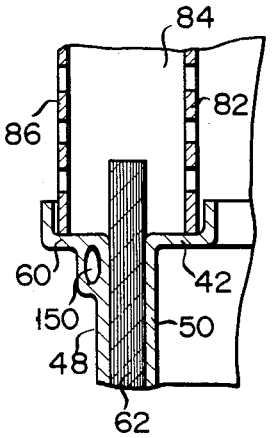
Figure 10:
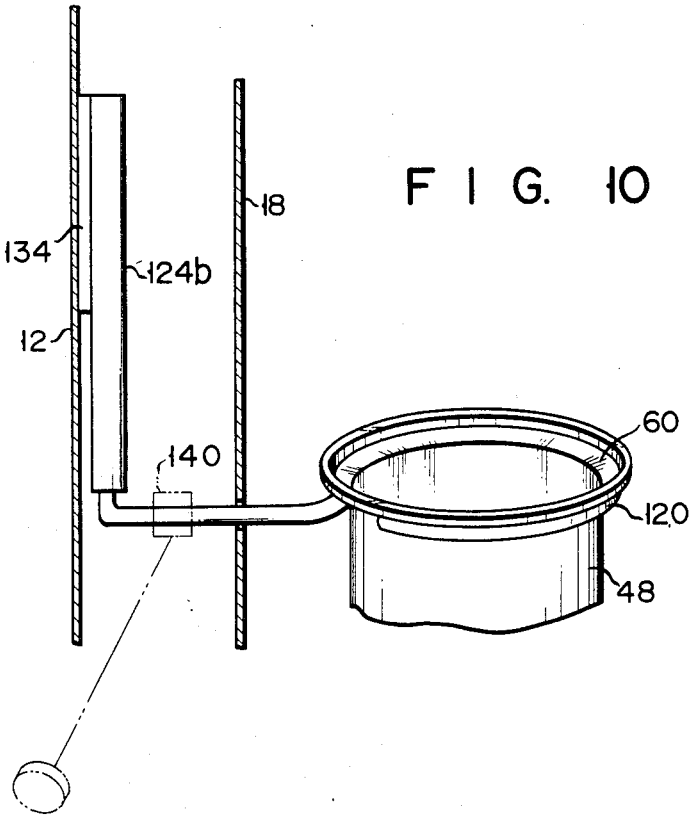
FIG. 10 is a schematic view showing a modification of the wick temperature control unit.

The present invention is not limited to the first and second embodiments shown in FIGS. 1 to 5 and FIG. 6. Various changes and modifications may be made within the spirit and scope of the invention. For example, as shown in FIG. 7, a heat radiator 124*a* having fins 146 extending outward therefrom can be used as the radiator component of the wick temperature control unit. The radiator 124*a* can be fixed by a support member 148 on the housing wall located at the rear side of the reflector. As shown in FIG. 8, the pipe 120 as the component of the wick temperature control unit can be disposed at a position which is located inside the upper end portion of the cylinder 48 and which is in direct contact with the outer surface of the wick 62. As shown in FIG. 9, a liquid communication hole 150 can be formed in the upper end portion of the cylinder 48 along the circumferential direction and can be used as a heat-absorbing pipe. Furthermore, as shown in FIG. 10, the ends of the pipe 120 and a radiator 124*b* can be connected in the same manner so as to constitute a conventional heat pipe. In this case, a valve 140 can be inserted between the pipe 120 and the radiator 124*b* so as to perform heating power adjustment while the exposed portion of the wick is kept constant as shown in FIG. 6. In each of the embodiments shown in FIGS. 4 and 6, the thin pipe 122 need not be used. However, this pipe is provided for increasing the heat transfer amount. The working fluid can comprise water, ammonium or Freon in addition to alcohol. The present invention is not limited to the kerosene stove, and can be extended to any space heater using alcohol, for example, as fuel.

What is claimed is:

1. A space heater comprising:

a fuel tank for storing liquid fuel;

a combustion chamber formed above said fuel tank;

means defining a narrow path, for communicating said combustion chamber with said fuel tank;

a wick, a lower end portion of which is dipped in the liquid fuel in said fuel tank and an upper end portion of which is inserted in said narrow path to soak up the liquid fuel by capillary action, said wick being adapted to evaporate the soaked up liquid fuel;

a wick position control mechanism for moving said upper end portion upward in said combustion chamber in a combustion state and moving said upper end portion downward in said narrow path in an extinguished state; and wick temperature control means including a heat-absorbing pipe for absorbing heat from said wick, a heat radiator connected in tandem with said heat-absorbing pipe and working fluid sealed in a space defined by said heat-absorbing pipe and said heat radiator, wherein said heat-absorbing pipe is located in contact with the surface of the wick inside said upper end portion of said narrow path.

2. A space heater according to claim 1, wherein said wick has a cylindrical shape.

3. A space heater according to claim 1, wherein said narrow path has a sectional shape such that all or part of the inner surfaces of said narrow path are in contact with all or part of the surface of said wick.

4. A space heater according to claim 3, wherein said narrow path has a sectional shape so as to pass said cylindrical wick therethrough.

5. A space heater according to claim 4, wherein said means defining said narrow path comprises an inner wick guide metal cylinder and an outer wick guide metal cylinder concentric with said inner wick guide metal cylinder.

6. A space heater according to claim 5, wherein a grate is integrally formed with an upper end portion of said inner wick guide metal cylinder so as to extend inward therein, and a grate is integrally formed with an upper end portion of said outer wick guide cylinder so as to extend outward therefrom.

7. A space heater according to claim 5, wherein at least one of the upper end portions of said outer and inner wick guide metal cylinders has a first portion extending horizontally away from said wick, a second portion extending upward by a predetermined length from a distal end of said first portion, and a grate portion extending from a distal end of said second portion.

8. A space heater according to claim 7, wherein said second portion has a plurality of air vent holes.

9. A space heater according to claim 1, wherein said combustion chamber comprises an inner flame cylinder, and an outer flame cylinder.

10. A space heater according to claim 1, further comprising a valve inserted between said heat-absorbing pipe and said heat radiator to control the flow rate of said working fluid.

11. A space heater according to claim 1, wherein said heat-absorbing pipe and said heat radiator are connected to constitute ends.

12. A space heater heater according to claim 1, wherein said heat-absorbing pipe and said heat radiator are connected to constitute a loop.

13. A space heater according to claim 1, wherein said working fluid comprises a material selected from the group consisting of water, alcohol, ammonium and Freon.

14. A space heater comprising:

a fuel tank for storing liquid fuel;

a combustion chamber formed above said fuel tank;

means defining a narrow path, for communicating said combustion chamber with said fuel tank;

a wick, a lower end portion of which is dipped in the liquid fuel in said fuel tank and an upper end portion of which is inserted in said narrow path to soak up the liquid fuel by capillary action, said wick being adapted to evaporate the soaked up liquid fuel;

a wick position control mechanism for moving said upper end portion upward in said combustion chamber in a combustion state and moving said upper end portion downward in said narrow path in an extinguished state; and wick temperature control means including a heat-absorbing pipe for absorbing heat from said wick, a heat radiator connected in tandem with said heat-absorbing pipe and working fluid sealed in a space defined by said heat-absorbing pipe and said heat radiator, wherein said heat-absorbing pipe is located in the upper portion of, and in tight contact with said means defining the narrow path.

15. A space heater comprising:

a fuel tank for storing liquid fuel;

a combustion chamber formed above said fuel tank;

means defining a narrow path, for communicating said combustion chamber with said fuel tank;

a wick, a lower end portion of which is dipped in the liquid fuel in said fuel tank and an upper end portion of which is inserted in said narrow path to soak up the liquid fuel by capillary action, said wick being adapted to evaporate the soaked up liquid fuel;

a wick position control mechanism for moving said upper end portion upward in said combustion chamber in a combustion state and moving said upper end portion downward in said narrow path in an extinguished state; and wick temperature control means including a heat-absorbing pipe for abosrbing heat from said wick, a heat radiator connected in tandem with said heat-absorbing pipe and working fluid sealed in a space defined by said heat-absorbing pipe and said heat radiator, wherein said heat-absorbing pipe is constituted by a fluid communication hole formed in an upper end portion of a member constituting said narrow path.

16. A space heater comprising:

a fuel tank for storing liquid fuel;

a combustion chamber formed above said fuel tank;

means defining a narrow path, for communicating said combustion chamber with said fuel tank;

a wick, a lower end portion of which is dipped in the liquid fuel in said fuel tank and an upper end portion of which is inserted in said narrow path to soak up the liquid fuel by capillary action, said wick being adapted to evaporate the soaked up liquid fuel;

a wick position control mechanism for moving said upper end portion upward in said combustion chamber in a combustion state and moving said upper end portion downward in said narrow path in an extinguished state; and wick temperature control means including a heat-absorbing pipe for absorbing heat from said wick, a heat radiator connected in tandem with said heat-absorbing pipe and working fluid sealed in a space defined by said heat-absorbing pipe and said heat radiator; and an air bubble pump pipe inserted between said heat-absorbing pipe and said heat radiator.

17. A space heater comprising:

a fuel tank for storing liquid fuel;

a combustion chamber formed above said fuel tank;

means defining a narrow path, for communicating said combustion chamber with said fuel tank;

a wick, a lower end portion of which is dipped in the liquid fuel in said fuel tank and an upper end portion of which is inserted in said narrow path to soak up the luquid fuel by capillary action, said wick being adapted to evaporate the soaked up liquid fuel;

a wick position mechanism for moving said upper end portion upward in said combustion chamber in a combustion state and moving said upper end portion downward in said narrow path in an extinguished state; and wick temperature control means in-cluding a heat-absorbing pipe for absorbint heat from said wick, a heat radiator connected in tandem with said heat-absorbing pipe and working fluid sealed in a space defined by said heat-absorbing pipe and said heat radiator, wherein said heat radiator is fixed in thermal contact with a housing which covers said fuel tank.

18. A space heater as in any one of claims 14–17, wherein said wick has a cylindrical shape.

19. A space heater as in any one of claims 14–17, wherein said narrow path has a sectional shape such that all or part of the inner surfaces of said narrow path are in contact with all or part of the surfaces of said wick.

20. A space heater according to claim 19, wherein said narrow path has a sectional shape so as to pass said cylindrical wick therethrough.

21. A space heater according to claim 20. wherein said narrow path comprises an inner wick guide metal cylinder and an outer wick guide metal cylinder concentrical with said inner wick guide metal cylinder.

22. A space heater according to claim 21, wherein a grate is integrally formed with an upper edd portion of said inner wick guide metal cylinder so as to extend inward therein, and a grate is integrally formed with an upper end portion of said outer wick guide cylinder so as to extend outward therefrom.

23. A space heater according to claim 21, wherein at least one of the upper end portions of said outer inner wick guide metal cylinders has a first portion extending horizontally away from said wick, a second portion extending upward by a predetermined length from a distal end of said first portion, and a grate portion extending from a distal and of said second portion.

24. A space heater according to claim 23, wherein said second portion has a plurality of air vent holes.

25. A space heater as in any one of claims 14–17, wherein said combustion chamber comprises an inner flame cylinder, and an outer flame cylinder.

26. A space heater as in any one of claims 14–17, further comprising a valve inserted between said heat-absorbing pipe and said heat radiator to control the flow rate of said working fluid.

27. A space heater as in any one of claims 14–17, wherein said heat-absorbing pipe and said heat radiator are connected to constitute ends.

28. A space heater as in any one of claims 14–17, wherein said heat-absorbing pipe and said heat radiator are connected to constitute a loop.

29. A space heater according to claim 26, wherein said working fluid comprises a material selected from the group consisting of water, alcohol, ammonium and Freon.

* * * * *